US005385003A

United States Patent [19]

Nixon, Jr. et al.

[11] Patent Number: 5,385,003

[45] Date of Patent: Jan. 31, 1995

[54] METHOD AND APPARATUS FOR MOVING AND CLOSING PACKAGING TRAYS

[75] Inventors: Henry M. Nixon, Jr., Wayne; Frank Schell, Towaco, both of N.J.; Keith MacDonald, New York, N.Y.

[73] Assignee: Mahaffy & Harder Engineering Co., Fairfield, N.J.

[21] Appl. No.: 118,414

[22] Filed: Sep. 8, 1993

[51] Int. Cl.[6] ..... B65B 43/52; B65B 43/48; B65B 65/02

[52] U.S. Cl. ..... 53/471; 53/478; 53/485; 53/64; 53/69; 53/282; 53/329.3; 198/617; 198/717; 198/762; 198/832.1

[58] Field of Search ..... 53/64, 69, 478, 485, 53/329.3, 467, 471, 282; 198/617, 717, 718, 762, 728, 761, 832.1

[56] References Cited

U.S. PATENT DOCUMENTS

| | | | |
|---|---|---|---|
| 2,529,777 | 11/1950 | McInnis | 198/832.1 |
| 3,112,587 | 12/1963 | Anderson et al. | 53/329.3 X |
| 3,276,568 | 10/1966 | Hansen, Jr. et al. | 198/823.1 X |
| 3,555,768 | 1/1971 | Miller | 53/64 X |
| 4,019,624 | 4/1977 | Torres | 198/728 X |
| 5,065,563 | 11/1991 | Robache | 53/69 |
| 5,287,957 | 2/1994 | Iuchi et al. | 198/823.1 X |

*Primary Examiner*—Horace M. Culver
*Attorney, Agent, or Firm*—Parmelee, Bollinger & Bramblett

[57] ABSTRACT

In order to prevent spilling the contents or fracturing a package being filled, a rigid tray is moved into a filling area by pushers in which the pusher is advanced under controlled acceleration and then deceleration for gently stopping the pusher in contact with or in close proximity to a filled tray. A short time delay in movement of the tray is provided and then the pusher is advanced along with the tray moved thereby under a controlled acceleration into a sealing station. The tray is brought under controlled deceleration to stop in the sealing station at a predetermined position where another short time delay is provided in the stop position of the pusher. The pusher is then retracted to a safe position out of the way in order to permit the sealing of the tray without the interference of the pusher while the tray is sealed. The sealed tray is then transferred to an outfeed area and the sequence is repeated for filling and sealing a following tray. The machine includes a digital indexer which is programmed for index length, acceleration/deceleration time and other associated scaling constants.

3 Claims, 2 Drawing Sheets

METHOD AND APPARATUS FOR MOVING AND CLOSING PACKAGING TRAYS

BACKGROUND OF THE INVENTION

This invention relates to a method and apparatus for filling, moving and closing packaging trays, and more particularly to the controlled movement of a filled package prior and subsequent to the sealing of the filled packages for preventing the spilling of contents or the fracture of the packages being filled and sealed.

U.S. Pat. 5,065,563 discloses a packaging machine in which packaging trays are moved by push bars attached to driving chains which form a closed loop. The trays are displaced one behind the other into a filling station and then out of the filling station to discharge the closed packaging trays. The trays are pushed into the filling station and then the pusher is moved backward away from the tray in the filling station to permit vacuum welding meaning to weld thermoplastic film onto the tray in the filling station, and thereafter reversing the movement of the pusher so that the tray is again contacted by a pusher and moved out of the filling station and to move another tray into the filling station. The purpose of the movement is to move the pusher out of the way of the welding apparatus so as not to interfere with the welding after the package has been filled in that station. The problem with this approach is that the combination of the filling and welding station is impractical and the switch controlled movement disclosed would not be appropriate for a package filled in a loading area which is then transported to a welding station in view of the fact that the movement of the pushers could spill liquid contents in the movement or on the other hand damage or fracture the filled package prior or subsequent to sealing.

SUMMARY OF THE INVENTION

Accordingly, it is an object of this invention to provide a new and improved method and apparatus for moving and closing filled packaging trays which will not spill the contents or fracture the package being filled.

In carrying out this invention in one illustrative embodiment thereof, a method and apparatus are provided for closing filled packages in a packaging machine by moving a rigid tray into a loading area by a pusher in a series of evenly spaced pushers and filling the tray. After filling, the tray is advanced by the pusher under controlled acceleration and then deceleration for gently stopping the pusher in contact with or in close proximity to the filled tray, thereby preventing the jarring or spilling of the contents of the filled tray. A short time delay is provided in the movement of the tray, and then the pusher is advanced and the tray moved thereby under controlled acceleration into a sealing station, bringing the tray under controlled deceleration to a stop at a predetermined position in the sealing station. Another short time delay is provided in the stop position of the pusher which is then retracted to a safe position out of the way in order to permit the sealing of the tray without interference by the pusher. The sealing takes place and then the closed tray is transferred to the outfeed area and the cycle repeated for filling and sealing a subsequent tray.

BRIEF DESCRIPTION OF THE DRAWINGS

The invention together with further objects, aspects, advantages and features thereof will be more clearly understood from the following description taken in connection with the accompanying drawings.

The present invention consists of a method and the apparatus required to transfer a rigid tray through a loading area into and out of a sealing area of the machine where a lid is applied to the tray and then moved to an unloading or outfeed area.

Figure 1:
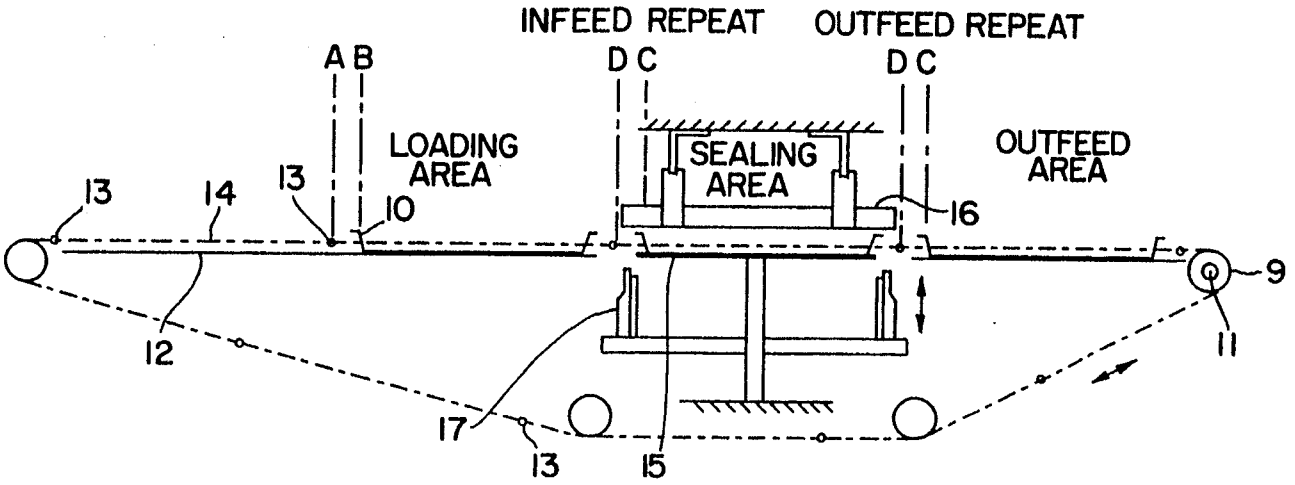
FIG. 1 is a schematic diagram of the method and apparatus employed in loading a rigid tray, moving the rigid tray into a sealing station, and sealing the tray which is then moved to an outfeed area.
Figure 2:
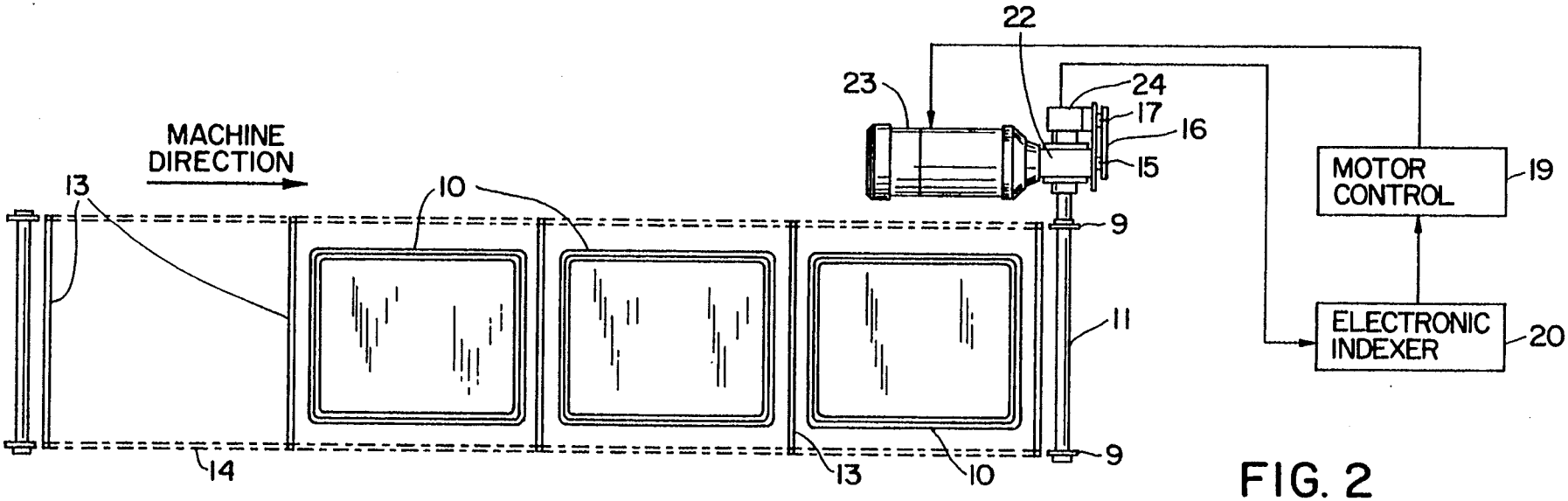
FIG. 2 is a top view illustrating the conveyor system of FIG. 1 along with the means for driving and controlling the movement of the conveyor illustrated in FIG. 1.

Referring now to FIGS. 1 and 2, a rigid tray 10 or plurality of such trays is placed either manually or automatically onto an input product support 12. As will best be seen in FIG. 2, one of a series of evenly spaced tray pushers 13 driven by an indexing drive chain pair 14 are used to move the trays 10 through the machine. As will again best be seen in FIG. 2, the chain pair 14 is driven by headshaft sprockets 9 mounted on a headshaft 11. The headshaft 11 is driven through a mechanical speed reducer 22 by a DC electric motor 23.

As will best be seen in FIG. 1, the pusher 13 starts in position A at rest. After receiving a signal from the machine control system as will be explained hereinafter, the pusher 13 is advanced to position B under controlled acceleration and deceleration and is gently stopped in contact with or in close proximity to the tray 10 shown in the loading area of FIG. 1. The loading area may comprise one or more stations. After a very short time delay, the pusher 13 is advanced under controlled acceleration, and transfers a filled tray into the sealing area bringing the tray 10 to a stop on a product support 15. The movement from position B to C is under a controlled acceleration and deceleration to a precise position C determined by an electronic indexer 20 of the control system which will be described hereinafter. After another very short delay, the pusher 13 is retracted from position C to position D in order to permit a tray sealing sequence to be accomplished without the pusher interfering with a sealing chamber 17 and a sealing bar assembly 16 which are brought together to seal a cover on the filled rigid tray 10.

Upon a signal from the machine control system that the pushers 13 have stopped in the retracted position D, the sealing chamber 17 is raised into contact with the sealing bar assembly 16 and the sealing steps are accomplished. The sealing procedure which may include the evacuation of the filled tray 10, the injection of gas, sealing, venting and a trimming operation, which procedures are old and do not constitute a part of the present invention, and accordingly are not described in detail. When the sealing process is completed, the sealing chamber 17 is lowered and a signal is sent to the machine control system, setting up a repetition operation. Accordingly, if another tray is in place, the indexing sequence is repeated, presenting another tray to the sealing area and transferring the completed tray to an outfeed area.

Referring again to FIG. 2, the motor 23 is controlled by a motor controller 19 in combination with the digital electronic indexer 20. Position and velocity feedback are provided to the electronic indexer 20 by an incremental position encoder 24 driven by the output from the speed reducer 22 through timing pulleys 15 and 17 through a timing belt 16. The electronic indexer 20 is programmed in accordance with the timing diagram shown in FIG. 3 having a plurality of trapezoidal curves 26, 28, and 30. Very short time delays 27, 29, and 31 correspond and occur during machine positions B, C, and D, respectively. The upward ramps of the trapezoids 26, 28, and 30 indicate acceleration time while the descending ramps of those trapezoids represent deceleration time which are designed to bring the pushers 13 into gentle contact with the trays 10. Position A represents the starting or home position of the machine. In position B, the pusher 13 advances to this position and stops in close proximity or in contact with the tray 13. In position C, the tray 13 is accelerated in a controlled manner and transferred with a controlled deceleration to a stop in a predetermined precise location C. In position D, the pusher retracts to permit the operation of the sealing chamber 7. The reverse drive is indicated by the curve 30. The cycle illustrated in FIG. 2 is shown as a transfer out and it should be noted that the transfer in function is identical in motion as all pushers are driven by the same chain pair.

The electronic drive system is comprised of a DC motor 23 controlled by a variable speed DC motor controller 19 in combination with a digital indexer 20. The digital indexer 20 is programmed for index length, acceleration/deceleration time, and other associated scaling constants. When the system is enabled, the indexer 20 outputs an isolated reference signal to the DC motor controller 19 which determines the motor speed and distance travelled. The incremental position encoder 24 provides feedback to the electronic indexer 20 representative of the motion. The indexer 20 uses this position feedback to continually calculate the reference signal applied for driving the motor 23. In addition, the electronic indexer 20 generates a tachometer signal based on the encoder pulses to close the velocity loop around the motor controller which is typical of a basic servo system having both position and velocity feedback.

Figure 3:
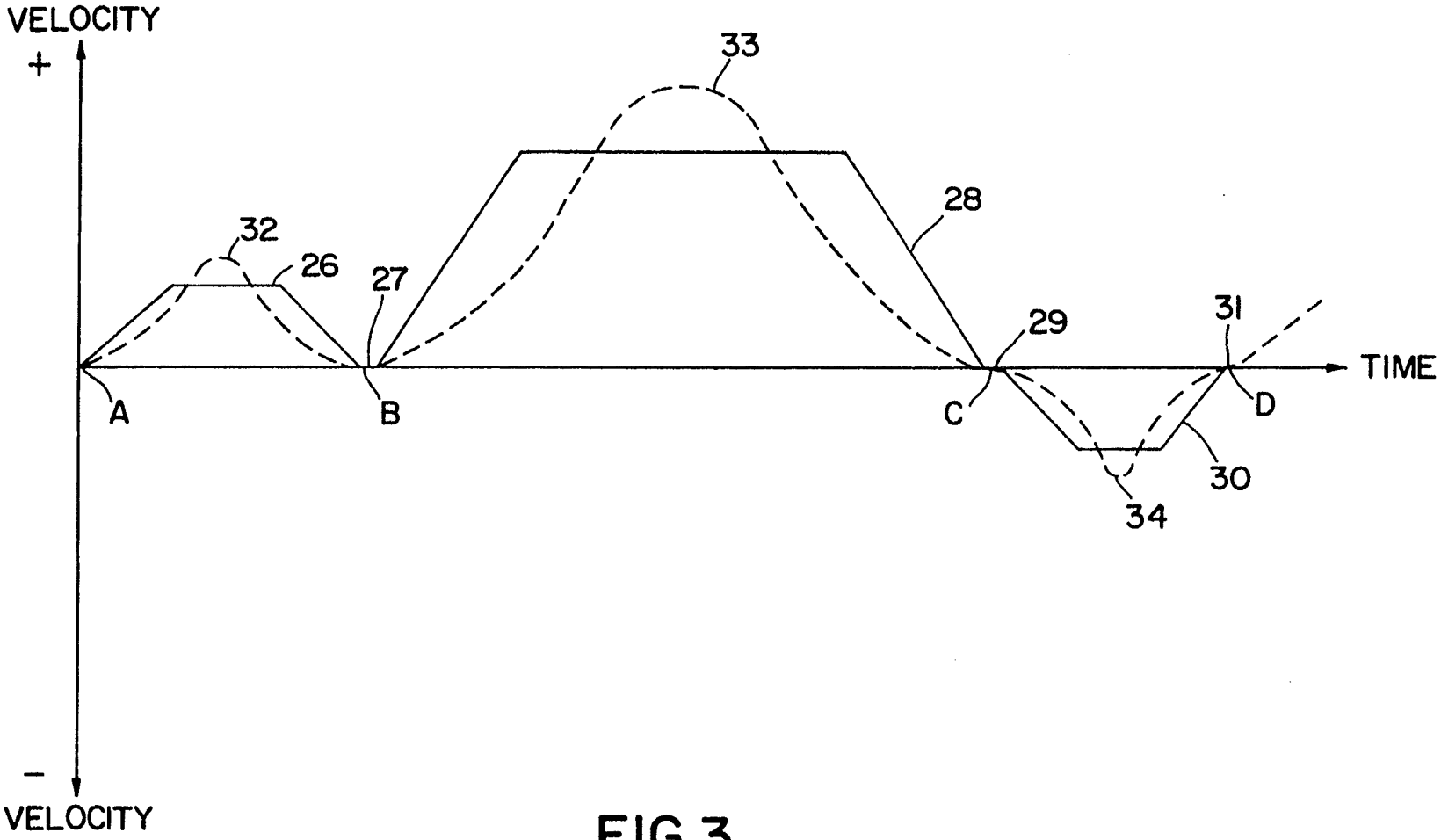
FIG. 3 is a timing diagram illustrating velocity vs. time which is programmed into the electronic indexer of the motor control circuit illustrated in FIG. 2.

The trapezoidal motion curves 26, 28, and 30 illustrated in FIG. 3 could be replaced by an alternative modified sine or "S" curve motion as illustrated by the curves 32, 33, and 34.

A packaging machine utilizing the transfer method described could handle more than one tray per cycle if required. In addition, the method is not limited in terms of sealing methods or packaging materials with the exception that the tray must be substantial enough to withstand general pushing by the pusher when filled. It will be understood by those skilled in the art that similar methods or controlling of the motor, including the use of AC motors, may be utilized and the foregoing is not limited to the control methods described.

The transfer method and apparatus described provide a distinct advantage in transferring loaded packages which have a high liquid content due to the manner of movement in which the pushers are moved with controlled deceleration to gently place the pusher bar in contact with the tray. Further, when the pushers are stopped in transporting a filled tray, there is again a deceleration which prevents abrupt stopping tending to jar or spill liquid contents from the tray which could result using switch control arrangements. Accordingly, the transfer system described greatly limits the jarring and fracturing of filled packages which could more readily occur in machines in which are controlled by limit type switching arrangements or methods which do not incorporate the two advancing sequence.

Since other and modifications vary to fit particular operating requirements and environments will be apparent to those skilled in the art, the invention is not considered limited to the examples chosen for purposes of illustration, and includes all changes and modifications which do not constitute a departure from the true spirit and scope of this invention as claimed in the following claims and equivalents thereto.

What is claimed is:

1. In a packing machine for moving filled packages into a sealing station where the filled packages are sealed comprising a conveyer having a series of evenly spaced tray pushers between which rigid trays are positioned for the movement of said trays through said machine, a filling area for the loading of said trays, a sealing station for sealingly covering said loaded trays, an indexing chain pair drive means coupled to said spaced tray pushers, motor drive means coupled to said indexing chain pair drive means for controlling the movement of said spaced tray pushers, a motor controller coupled to said motor, an incremental position encoder coupled to said spaced tray pushers for determining the position of said tray pushers, a digital electronic indexer programmed for the controlled movement of said tray pushers with respect to acceleration rate and time, velocity, deceleration rate and time and index distance, means for coupling said digital electronics indexer between said encoder and said motor controller for precisely controlling the movement, including both the acceleration and deceleration rates of said pushers, thereby preventing jamming, damaging trays, and spilling of the contents of the trays prior to sealing.

2. The packaging machine as set forth in claim 1 including a headshaft having headshaft sprockets mounted thereon which sprockets are coupled to and drive said indexing chain pair drive means, a speed reducer coupled between said headshaft and said motor, and means for coupling said position encoder to said speed reducer whereby position and velocity feedback are provided to said electronic indexer by said position encoder driven by the output from said speed reducer which is in mechanical communication with said sprockets for driving said indexing chain pair drive means.

3. The method of closing filled packages in a packaging machine comprising the steps of moving a rigid tray into a filling area by a pusher in a series of evenly spaced pushers, filling the tray, advancing the pusher under controlled acceleration and then deceleration for gently stopping the pusher in contact with or in close proximity to said filled tray, thereby preventing jarring or spilling of the contents of the filled tray, or damaging trays.

advancing the pusher and the tray moved thereby under controlled acceleration into a sealing station, bringing the tray under controlled deceleration to a stop at a predetermined position in said sealing station, retracting said pusher in a safe position out of the way in order to permit sealing the tray without interference by the pusher, sealing the tray, transferring the sealed tray to an outfeed area by said pusher under controlled acceleration and deceleration, and repeating the above sequence for the filling and sealing of a subsequent tray.

* * * * *